United States Patent [19]

Williams

[11] 4,201,379

[45] May 6, 1980

[54] MARTIAL ARTS PRACTICE BAG

[76] Inventor: Clarence Williams, 2501 W. Lombard St., Baltimore, Md. 21223

[21] Appl. No.: 904,217

[22] Filed: May 9, 1978

[51] Int. Cl.[2] ..... A63B 69/00

[52] U.S. Cl. ..... 272/76

[58] Field of Search ..... 272/76, 77, 78, 98; 273/26 A, 29 A, 181 R, 181 A, 1 F, 55 R, 55 A, 1, 102 R, 106.5 R, 102 B, 105 R, 105.4

[56] References Cited

U.S. PATENT DOCUMENTS

| | | | |
|---|---|---|---|
| 1,199,564 | 9/1916 | Judge | 273/102 R |
| 1,276,959 | 8/1918 | Riebe | 272/98 |
| 3,147,976 | 9/1964 | Miller | 273/102 R |
| 4,093,217 | 6/1978 | Piccini | 273/26 R |

*Primary Examiner*—Richard C. Pinkham
*Assistant Examiner*—T. Brown
*Attorney, Agent, or Firm*—Walter G. Finch

[57] ABSTRACT

The invention is an improved apparatus for practicing the martial arts, such as the various forms of Karate, known by various names and taught in several styles. The practice bag of this invention provides a means for sharpening reflexes and coordination without the need of a skilled human opponent. The practice bag consists of a covered cylindrical bag with four cylindrical-like apertures therethrough, said apertures being lined, said lining being suitably fastened to the bag at each point where the cylindrical-like apertures interface with cover of the bag. A center target piece is attached to the exterior of the cover of the bag and more-or-less centrally located between the apertures on one side of the bag. The bag is filled with a suitable material which surrounds the cylindrical-like apertures passing through the bag. Cable-like attachments to the top of bag support it from above. Rod-like poles with padded ends are extended through each of the four cylindrical-like apertures to simulate the arms and legs of an opponent. The simulated arms and legs can be manipulated for practice of the martial arts.

6 Claims, 4 Drawing Figures

MARTIAL ARTS PRACTICE BAG

BACKGROUND AND SUMMARY OF THE INVENTION

The invention relates to athletic type training apparatus and in particular to training apparatus for the martial arts. Specifically, it is for the martial arts in those forms known as Karate; karate having various names associated with several styles that are taught. The invention is also useful in sharpening skills in certain related sports such as boxing.

A need has existed for some means to permit a follower of the martial arts, particularly in the various forms of Karate, to practice with a simulated opponent. Such a simulated opponent would have specific advantages over the usual method of practice, without an opponent, which approximates shadow boxing (going through the motions of various types of blocks, thrusts, couner-punching, and other movements with the hands, arms, feet, and legs).

The present invention consists of a filled bag representing the body, with a marked body point target for aiming punches and kicks, a pair of simulated arms and hands, and a pair of simulated legs and feet. The apparatus hangs on a swivel type mounting so that it is free to swing like the movement of the body.

The simulated arms and legs are moved by an assistant to represent the opponent's punches or kicks. The assistant need not be a skilled performer of the martial arts or one with any knowlege of the martial arts, but merely one to provide a random movement of the simulated body parts to which the user reacts. It is to be noted that the device may be used without an assistant, however, this is a less effective way to obtain the full benefits of the training apparatus.

Some training has been attempted by an assistant (skilled or unskilled) merely poking a padded stick at a trainee. However, this provides no means by which the trainee can react completely by landing a blow or a kick to a simulated body in additon to practicing a block. This invention provides that opportunity to not only practice a block, but to practice a retaliation as well. Such padded sticks are sometimes referred to as a "Bo." That term will be used hereinafter in describing the present invention and its use.

It is, therefore, an object of the invention to provide a simulated body for practicing the martial arts.

It is a further object of the invention to provide a simulated body with simulated arms and hands in operating position simulating movements in the martial arts.

It is another object of the invention to provide a simulated body with simulated legs and feed in operating position simulating movements in the martial arts.

It is still another object of the invention to provide a simulated body with a marked target area for practicing a follow through punch or kick after a block of the simulated arm or leg movements.

It is yet another object of the invention to provide a martial arts training apparatus that may be used with or without the help of an assistant.

It is also an object of the invention to provide a martial arts training apparatus that may be used without the need for the assistant to have the skill or knowledge of one who is expert in the martial arts.

Further objects and advantages of the invention will become more apparent in light of the following description of the preferred embodiments.

DESCRIPTION OF THE PREFERRED EMBODIMENTS

Figure 1:
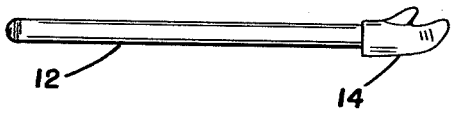
FIG. 1 is a side view of a simulated extremity of the body.
Figure 2:
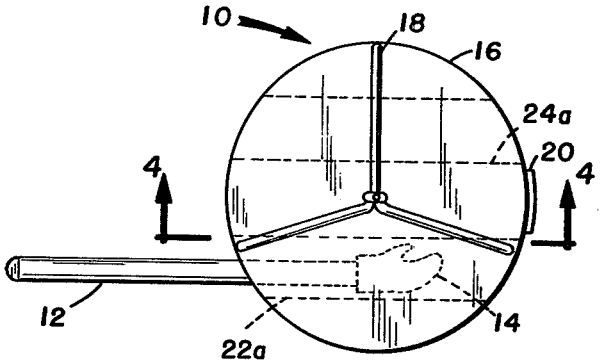
FIG. 2 is a top view of a simulated body, showing a simulated extremity of the body in place in the body.
Figure 3:
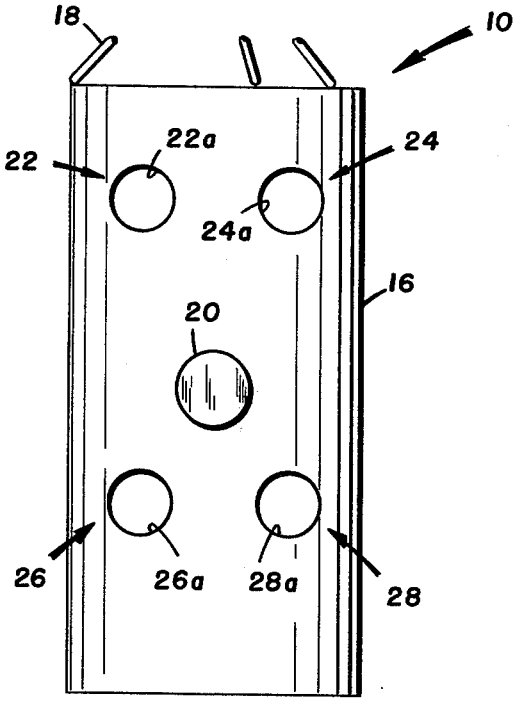
FIG. 3 is a view of a simulated body from the target point side.

Referring now to the drawings, and particularly to FIGS. 2 and 3, the simulated body, representing the martial arts practice bag, is shown at 10. In FIG. 2 one of the simulated extremities as illustrated in FIG. 1 is shown in place in the bag 10.

Referring next to FIG. 1, a simulated extremity is shown consisting of a pole, rod, or handle 12 and a padded end 14. The padded end 14 may be a light weight boxing glove (as illustrated) or similar structure. The padded end 14 may be tied to the handle 12, or may be glued or otherwise secured in position.

The illustrated simulated extremity in FIG. 1 appears to be an arm and a hand, however, it is not necessary that any extremity be realistically portrayed. This combination of a handle 12, and a padded end 14 is usually referred to as a "Bo" in the martial arts. The representation for the simulated leg and foot may be exactly the same shape and configuration as the Bo used for the arm and hand, or it may be somewhat more realistically portrayed. Either way, or merely padded ends 14, are within the scope and intent of this invention as such variations in the exterior physical characteristics of the padded end 14 are immaterial to the operation and use of the invention.

The bag 10 has an exterior cover 16 that covers the entire outside around the cylindrical periphery of bag 10 and the top and bottom surfaces to fully enclose the main structure of bag 10.

Figure 4:
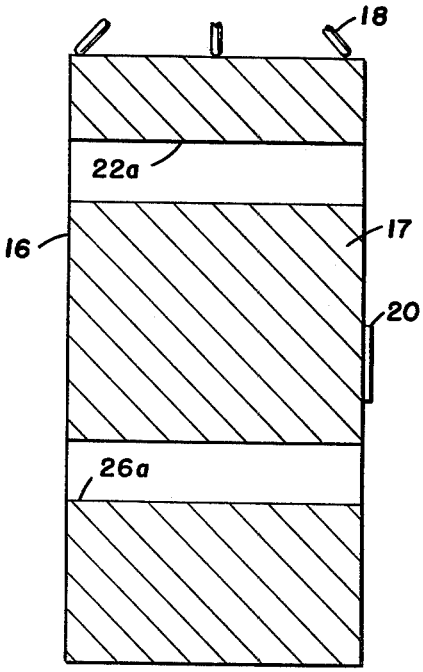
FIG. 4 is a section taken on line 4—4 of FIG. 2.

Four apertures 22, 24, 26, and 28 pass through bag 10 from the target or front side to the back side of the bag 10. The same material is used to line the inside of apertures 22, 24, 26, and 28 as is used for the exterior cover 16. This internal lining of the apertures 22, 24, 26, and 28 is shown in FIGS. 2, 3, and 4 as **22*a* for aperture 22, 24*a* for aperture 24, 26*a* for aperture 26, and 28*a* for aperture 28**.

The bag 10 is supported overhead by straps or cables 18 attached to it, similar to the supports of an ordinary punching bag used in boxing.

A flexible target disc 20 is affixed to the front or target side, as shown in FIG. 3, at approximately the mid-section of the bag 10 centered between said apertures, which would also approximate the mid-section of the human torso which bag 10 simulates. The target disc 20 may be of any material or color so that it is easily apparent to the user for aiming blows and kicks. It may be cemented or stitched to the bag 10 covering 16. The cementing or stitching is not illustrated on the drawings.

The covering 16 surrounding the cylindrical periphery of bag 10 may be cemented or stitched by sewing together at the juncture where the covering 16 ends meet. Likewise the top and bottom covering 16 may be cemented or stitched by sewing to the covering 16 surrounding the cylindrical periphery of bag 10 to complete the enclosure of bag 10. In a like manner the covering 16 which provides the interior linings 22*a*, 24*a*, 26*a*, and 28*a* may be cemented or stitched into a cylindrical structure to form the apertures 22, 24, 26, and 28 and then cemented or stitched by sewing to the exterior covering 16 where the apertures 22, 24, 26, and 28 begin and end in passage through bag 10. The cementing or stitching is not illustrated in the drawings.

Before closing of the covering 16 on bag 10, the bag 10 is filled or stuffed with a suitable stuffing material 17 to provide a more or less solid bulk when struck by blows or kicks. Such material may be cotton, wool, synthetic materials, or any similar suitable stuffing material. All such stuffing materials are within the scope and intent of this invention. After the bag 10 is filled with the stuffing material 17, the final closing of the covering 16 is made by cementing or stitching.

It is to be noted that in FIG. 2, the Bo is shown with the padded end 14 within the aperture 22. This is one embodiment, the padded end 14 may be made larger than the aperture 22, 24, 26, or 28 and always remain exposed on the target side of bag 10. Either way is within the scope and intent of the invention.

One advantage of the padded end 14 being within the aperture 22, 24, 26, or 28 is that the user has less indication which Bo the assistant will operate on a random basis. An advantage of the padded end being larger than the aperture 22, 24, 26 or 28 is that the user will find it more convenient to use the bag 10 when an assistant is not available.

An illustration of the use of the bag 10 for practicing the martial arts is given below. The illustration is provided as if an assistant is working with the user. If working alone, the user himself extends a Bo and then reacts accordingly. However, in this latter situation there is no element of surprise and the practice is merely one of responding to a given situation, which he knows beforehand, having set the Bo.

In the practice of the martial arts the areas of the body are often referred to in such terms as inside and outside, and upper and lower. Also, the position area of each arm and its hand and each leg and its foot are referred to as gates. These terms will be used in the illustration below for use of the invention. From the standpoint of the opponent's position, his right arm area would be the upper inside gate; for the left arm area it would be the upper outside gate; the right leg area would be the lower inside gate; and the left leg area would be the lower outside gate.

Thus, in the invention, the two upper apertures 22 and 24 are each for a Bo representing arms, and the two lower apertures 26 and 28 are each for a Bo representing legs. Two examples follow.

Hand Technique Example

1. Stand in front of bag in side horse stance.
2. When Bo approaches from upper outside gate position use —
   a. inside high block and punch to center target with right hand.
   b. then use downward circular block to Bo on upper inside gate position and use back hand to center target with right hand.

Foot Technique Example

1. Stand in front of bag in front horse stance.
2. When lower outside gate Bo approaches use foot block to stop it and continue foot to center target, executing a front snap kick.

As can be readily understood from the foregoing description of the invention, the present structure can be configured in different modes to provide a practice apparatus for the martial arts.

Accordingly, modifications and variations to which the invention is susceptible may be practice without departing from the scope and intent of the appended claims.

What is claimed is:

1. A martial arts practice system comprising:

a body means having a plurality of apertures therein, said body means being a cylindrically shaped bag-like structure having an exterior covering and additionally a top and bottom to enclose said cylindrically shaped bag-like structure, said structure being stuffed with a stuffing material, said plurality of apertures each being cylindrical and lined and passing through said body means, the exterior covering of said cylindrically shaped bag-like structure, the top, and the bottom of said cylindrically shaped bag-like structure, and the internal lining of said plurality of apertures through said body means are each attached together and attached to each other by a cementing material; and a plurality of operable extensions of rod-like structure, each removably inserted within one of said plurality of apertures, each said operable extension having a padding means affixed to one end thereof.

2. A martial arts practice system comprising:

a body means having a plurality of apertures therein, said body means being a cylindrically shaped bag-like structure having an exterior covering and additionally a top and bottom to enclose said cylindrically shaped bag-like structure, said structure being stuffed with a stuffing material, said plurality of apertures each being cylindrical and lined and passing through said body means, the exterior covering of said cylindrically shaped bag-like structure, the top, and the bottom of said cylindrically shaped bag-like structure, and the internal lining of said plurality of apertures through said body means are each attached together and attached to each other by stitching or sewing; and a plurality of operable extensions of rod-like structure, each removably inserted within one of said plurality of apertures, each said operable extension having a padding means affixed to one end thereof.

3. The martial arts practice system recited in claim 2, wherein said padding means is tied to the end of said rod-like member.

4. The martial arts practice system recited in claim 2, wherein said padding means is permanently affixed to the end of said rod-like member.

5. The martial arts practice system recited in claim 2, and additionally a flexible target disc permanently affixed to said body means and centered approximately at mid section between said plurality of apertures.

6. The martial arts practice system recited in claim 2, and additionally a support means affixed to one end of said body means to hang said martial arts practice system from an overhead support.

* * * * *